United States Patent [19]

Peche et al.

[11] 4,453,054

[45] Jun. 5, 1984

[54] CONTACT APPARATUS FOR VACUUM SWITCHES

[75] Inventors: Gerhard Peche; Günter Bialkowski, both of Berlin, Fed. Rep. of Germany

[73] Assignee: Siemens Aktiengesellschaft, Berlin and Munich, Fed. Rep. of Germany

[21] Appl. No.: 410,480

[22] Filed: Aug. 23, 1982

[30] Foreign Application Priority Data

Aug. 26, 1981 [DE] Fed. Rep. of Germany ..... 3133799

[51] Int. Cl.[3] ..... H01H 33/66

[52] U.S. Cl. ..... 200/144 B; 200/279

[58] Field of Search ..... 200/144 B, 279

[56] References Cited

U.S. PATENT DOCUMENTS 2,949,520 8/1960 Schneider ..... 200/144 B 4,243,859 1/1981 Peche ..... 200/144 B

FOREIGN PATENT DOCUMENTS 2740944 1/1980 Fed. Rep. of Germany .

*Primary Examiner*—E. A. Goldberg

*Assistant Examiner*—Morris Ginsburg

*Attorney, Agent, or Firm*—Herbert L. Lerner; Laurence A. Greenberg

[57] ABSTRACT

Contact apparatus for vacuum switches. It includes a fixed and a movable contact bolt. Each has an end portion with an end face facing the other. Two disc-shaped substantially identical contacts surround the end portion of each of the contact bolts, and each of the contact discs have an annular inner hollow space formed therein which define side walls which face each other and have closed inner and outer side wall surfaces. The contact discs have side walls facing away from each other and each is fastened to a corresponding one of the contact bolts. The end face of each of the end portions are located at a distance from the inner side wall surface of the corresponding one of the contact discs which defines a gap therebetween. The side walls of the contact discs have slots formed therein which are extended in the same direction, and has coil turns placed between the slots at a given slope which produces an axial magnetic field at the moment the contacts break.

8 Claims, 1 Drawing Figure

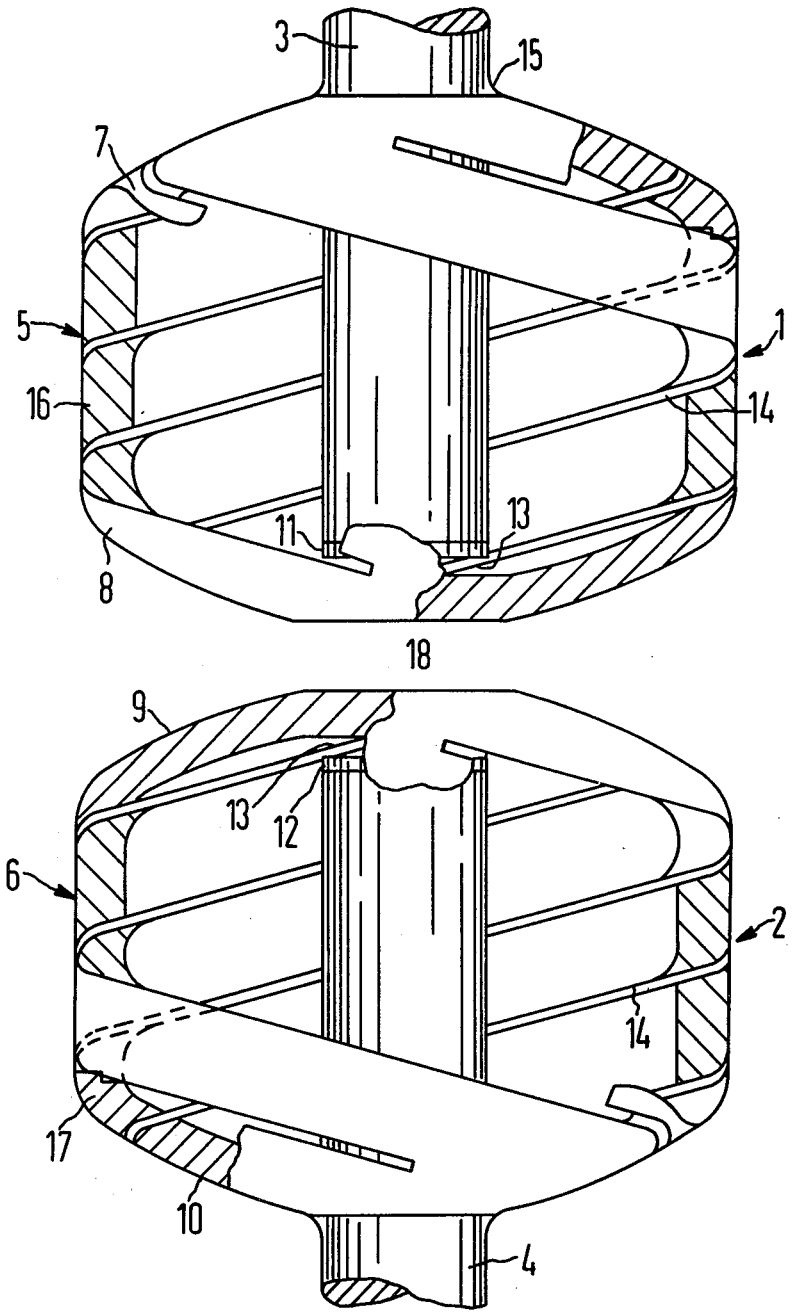
3
15
7
5
1
16
14
11
13
8
18
9
13
12
6
2
14
17
10
4

CONTACT APPARATUS FOR VACUUM SWITCHES

The invention relates to a contact apparatus for vacuum switches, including a fixed and a movable contact bolt each having an end portion with an end face facing each other, two discus-shaped substantially identical contact discs each surrounding the end portion of a respective one of the contact bolts, each of the contact discs having an annular inner hollow space formed therein defining side walls facing each other having closed inner and outer side wall surfaces and the contact discs having side walls facing away from each other each being fastened to a respective one of the contact bolts, the end face of each of the end portions being disposed at a distance from the inner side wall surface of a respective one of the contact discs defining a gap therebetween. Such a contact arrangement is known from German Pat. No. 27 40 994, corresponding to U.S. Pat. No. 4,243,859.

The switching capacity limit of vacuum switching tubes with discshaped contacts is as a rule lower than the switching capacity limit of cup-shaped contacts, if the metal vapor arc discharge circulates magnetically on the rim of the cup contact due to inclined slots in the cylindrical surface of the cup contact. Due to the revolving contracted arc discharge, excessive overheating of the contact material during the burning of the arc discharge is avoided. In recent years, a considerable increase of the breaking capacity limit of vacuum switch tubes has been achieved by providing an additional magnetic field parallel to the axis of the vacuum switching tube, which is produced directly by the current to be interrupted. Technically, solutions are known in which the current of the tube flows directly through a coil arrangement at the height or level of the arcing chamber, and generates the magnetic field required for the increase of the breaking capacity at the breaking instant. In this known technical solution, the operating and the short-circuit breaking current flows permanently through the coil placed around the arcing chamber of the tube and is electrically connected in series with the vacuum switching tube. This known technical solution has two disadvantages. First, the coil must be fully insulated from the arcing chamber, since at least one-half of the terminal voltage is present between the arcing chamber and the potential of the contact of the coil, in the "off" state. Second, the coil must be laid out for the operating and short-time current.

It is accordingly an object of the invention to provide a contact apparatus for vacuum switches, which overcomes the thereinafore-mentioned disadvantages of the heretofore-known devices of this general type, and which has a contact geometry such that an external coil is avoided.

With the foregoing and other objects in view there is provided, in accordance with the invention, a contact apparatus for vacuum switches, comprising a fixed and a movable contact bolt each having an end portion with an end face facing each other, two discus-shaped substantially identical contact discs each surrounding the end portion of a respective one of the contact bolts, each of the contact disc having an annular inner hollow space formed therein defining side walls facing each other having closed inner and outer side wall surfaces and the contact discs having side walls facing away from each other each being fastened to a respective one of the contact bolts, the end face of each of the end portions being disposed at a distance from the inner side wall surface of a respective one of the contact discs defining a gap therebetween, the side walls of the contact discs having slots formed therein extended in the same direction, and coil turns disposed between the slots at a given slope producing an axial magnetic field at the instant of breaking contact.

In accordance with another feature of the invention, the contact bolts are formed of copper.

In accordance with an added feature of the invention, the contact bolts are formed of copper containing substantially 1% of at least one of the materials from the group consisting of boron, beryllium, chromium and zirconium.

In accordance with a further feature of the invention, the side walls of the contact discs facing each other are formed of one of the materials from the group consisting of chromium-copper, tungsten-copper, cobalt-copper and molybdenum-copper.

In accordance with an additional feature of the invention, the side walls of the contact discs facing away from each other are formed of pure copper.

In accordance with a concomitant feature of the invention, the side walls of the contact discs facing away from each other are formed of an alloy of copper and 1 to 3% of at least one of the materials from the group consisting of boron, beryllium, chromium and zirconium.

The proposed contact geometry of the invention has the substantial advantage of permitting the external coil to be avoided. The extended, obliquely slotted discus-shaped contact discs generate the necessary axial magnetic field only at the breaking instant, by lifting the contact pins or bolts off the inside of the discus-shaped contact discs.

The construction and method of operation of the invention, however, together with additional objects and advantages thereof will be best understood from the following description of specific embodiments when read in connection with the single FIGURE of the drawing which is a fragmentary, diagrammatic, cross-sectional view, partly broken away, of a contact apparatus for vacuum switches according to a preferred embodiment of the invention.

Referring now to the drawing, there is seen a switch having contacts 1, 2, a fixed contact bolt 3, a movable contact bolt 4, and opposite end faces 11, 12 of the bolts 3, 4 which are surrounded by discus-shaped discs 5, 6, respectively. As can be seen, the discs 5, 6 have cylindrical side walls and a flattened end, similar to a discus. The discs 5, 6 have an annular hollow space on the inside thereof and they are fastened to the contact bolts 3, 4 at sides 7, 10 of the discs that face away from each other. The end faces 11, 12 of the contact bolts 3, 4 are set back relative to the inner walls of sides 8, 9 of the contact discs 5, 6 which face each other, forming respective inner gaps 13. The solid contact bolts 3, 4 are preferably formed of copper and their strength can advantageously be improved considerably by a 1% addition of boron, beryllium, chromium and/or zirconium. The end faces 11, 12 of the contact bolts 3 and 4 are superficially increased substantially by the discus-shaped contact discs 5, 6. The sides 8, 9 facing each other are made of a suitable arc-resistant contact material, preferably chromium-copper, tungsten-copper, cobalt-copper or molybdenum-copper and are hard-soldered to the contact bolts 3, 4 with the opposing sides 7, 10 of the discus-shaped switch contact discs 5, 6 at an annular outer seam. The sides of the contact discs 5, 6 facing away from each other preferably are formed of pure copper or of a copper alloy with 1 to 3% boron, beryllium, chromium and/or zirconium. For producing the axial field which substantially increases the breaking capacity limit, the discus-shaped contact discs 5, 6 surrounding the contact bolts 3, 4 are provided with slots 14 running in the same sense as each other, so that the bolts 3, 4 are only lifted off the discus-shaped contact discs 5, 6 at the instant of interruption when the contacts are relieved of load, forming the gaps 13, and the current is commutated to the discus-shaped contact discs in such a manner that it generates an axial magnetic field when it flows through these bodies in coil turns 16, 17. The contact force braced through the contact bolts, the closed gaps 13 and a main contact gap 18 exerts no forces on the discus-shaped contact body. At the instant of interruption, the necessary axial magnetic field is produced by the transition of the current from the contact bolts to the discus-shaped contact body. The metal vapor discharge in the main gap 18 only stresses the surface of the contact material slightly due to the magnetic field strength, since, due to the magnetic field, the arc cannot pass from the diffuse discharge to the contracted discharge, which can lead to dangerous overheating of the contact surface. Consequently, a magnetic movement of the discharge distributed over the entire surfaces 8, 9 can be dispensed with.

With increasing breaking capacity limit, the slot angle of the discus-shaped body relative to the axis must be increased in order to increase the number of turns generated by the slots, and thus the field strength as well. The same effect can also be achieved, while the angle of inclination is being kept constant, by lengthening the discus-shaped body. The contact geometry proposed by the invention is slightly elastic regarding the discus-shaped part, so that the inner gaps between the surfaces 11, 12 of the contact bolts 3, 4 and the inner walls of the sides 8, 9 of the contact discs 5, 6 facing each other also close. In this way, a low path resistance of the closed current path is achieved and the deformation of the discus discs is avoided. At the instant of breaking, the inner gaps 13 between the end faces 11, 12 of the contact bolts 3, 4 and the inner walls of the sides 8, 9 of the contact discs 5, 6 facing each other are opened, so that the arc drawn between the two sides 8, 9 facing each other is only fed through the contact discs 5, 6.

The invention as illustrated and described herein and as embodied in a contact apparatus for vacuum switches, is not intended to be limited to the details shown, since various modifications and structural changes may be made therein without departing from the spirit of the invention and the scope thereof as defined in the claims.

We claim:

1. Contact apparatus for vacuum switches, comprising a fixed and a movable contact bolt each having an end portion with an end face facing each other, two discus-shaped substantially identical contact discs each surrounding said end portion of a respective one of said contact bolts, each of said contact discs having an annular inner hollow space formed therein defining side walls facing each other having closed inner and outer side wall surfaces and said contact discs having side walls facing away from each other each being fastened to a respective one of said contact bolts, said end face of each of said end portions being disposed at a distance from said inner side wall surface of the corresponding one of said contact discs defining a gap therebetween, said side walls of said contact discs having slots formed therein said slots extended in the same direction, and coil turns disposed between said slots at a given slope producing an axial magnetic field at the instant of breaking contact.

2. Contact apparatus according to claim 1, wherein said contact bolts are formed of copper.

3. Contact apparatus according to claim 1, wherein said contact bolts are formed of copper containing substantially 1% of at least one of the materials from the group consisting of boron, beryllium, chromium and zirconium.

4. Contact apparatus according to claim 1, 2 or 3, wherein said side walls of said contact discs facing each other are formed of one of the materials from the group consisting of chromium-copper, tungsten-copper, cobalt-copper and molybdenum-copper.

5. Contact apparatus according to claim 1, 2 or 3, wherein said side walls of said contact discs facing away from each other are formed of pure copper.

6. Contact apparatus according to claim 4, wherein said side walls of said contact discs facing away from each other are formed of pure copper.

7. Contact apparatus according to claim 1, 2 or 3, wherein said side walls of said contact discs facing away from each other are formed of an alloy of copper and 1 to 3% of at least one of the materials from the group consisting of boron, beryllium, chromium and zirconium.

8. Contact apparatus according to claim 4, wherein said side walls of said contact discs facing away from each other are formed of an alloy of copper and 1 to 3% of at least one of the materials from the group consisting of boron, beryllium, chromium and zirconium.

* * * * *